US005359780A

United States Patent [19]

Dallaire

[11] Patent Number: 5,359,780

[45] Date of Patent: Nov. 1, 1994

[54] BOW SIGHT ASSEMBLY

[76] Inventor: Guy Dallaire, 83, 6iéme Avenue, Apt. 301, Montmagny, Canada, G5V 3W1

[21] Appl. No.: 174,707

[22] Filed: Dec. 29, 1993

[51] Int. Cl.[5] ..... F41G 1/467

[52] U.S. Cl. ..... 33/265; 124/87

[58] Field of Search ..... 33/265; 124/87; 356/21, 356/22

[56] References Cited

U.S. PATENT DOCUMENTS

| | | | |
|---|---|---|---|
| 3,355,809 | 12/1967 | Guyton . | |
| 3,696,517 | 10/1972 | Larson | 33/265 |
| 3,800,424 | 4/1974 | Saunders et al. | 33/265 |
| 3,875,674 | 4/1975 | Davidson | 33/265 |
| 4,109,390 | 8/1978 | Smith et al. | 33/265 |
| 4,178,693 | 12/1979 | Smith | 33/265 |
| 4,368,581 | 1/1983 | Tullos | 33/265 |
| 4,497,116 | 2/1985 | Hawkins | 33/265 |
| 4,796,364 | 1/1989 | Amacker | 33/265 |
| 4,953,302 | 9/1990 | Gould | 33/265 |
| 4,961,265 | 10/1990 | Roberts | 33/265 |
| 4,979,309 | 12/1990 | Oligschlaeger | 33/265 |
| 4,984,372 | 1/1991 | Blizzard | 33/265 |
| 4,995,166 | 2/1991 | Knemeyer | 33/265 |
| 5,001,837 | 3/1991 | Bray | 33/265 |
| 5,025,565 | 6/1991 | Stenerson et al. | 33/265 |

OTHER PUBLICATIONS

Adams, Chuck: "Win the Guessing Game", in Petersen's Bowhunting, May 1992, pp. 37–39.

*Primary Examiner*—Christopher W. Fulton
*Attorney, Agent, or Firm*—Kriegsman & Kriegsman

[57] ABSTRACT

The bow sight assembly is provided for use in archery, more particularly for use with a rangefinder, such as a split image rangefinder. The rangefinder is operated by moving a trigger connected to a positioning mechanism of the bow sight assembly until the instrument reads the range between the bow and the target. Simultaneously, a sight arm on which is located the sight pin rotates about a pivot in direct proportion to the movement of a vertical member connected to the rangefinder. In use, the setting of the sight positioning assembly allows the sight arm and its sight pin to be at the appropriate angle when the rangefinder is indicating the actual range between the bow and the target.

8 Claims, 5 Drawing Sheets

BOW SIGHT ASSEMBLY

FIELD OF THE INVENTION

The present invention relates to a bow sight assembly for use in archery. More particularly, it relates to a bow sight assembly for use with a rangefinder, such as a split image rangefinder.

BACKGROUND OF THE INVENTION

In archery, knowing the distance between the archer and the target is very important for shooting with accuracy. Since the path of an arrow is always curved upwardly for taking the gravity into account according to the laws of ballistics, the farther the target, the greater is the initial angle the arrow defines with the horizontal. Therefore, since the initial angle of the arrow is proportional to the range, the archer has to know or somehow evaluate the range in order to set the bow at the right angle before releasing the arrow. An error in the range evaluation may result in missing the center of the target or worse, hit non vital tissues and wound an animal when bow hunting.

For resolving this problem, one can use various instruments for finding the range between the target and the archer. Among the instruments for finding the range, a very effective one is the split image rangefinder which relies on an optical mechanism generating an image having two halves, which are generally a right and a left half. The user then changes the setting of the rangefinder until the two parts of the image appear to be aligned with each other. At that moment, the user can read the distance on the instrument scale and aim accordingly. However, when bow hunting, the archer may not have enough time to find the range, put the instrument away, take the bow, draw, aim and shoot if the prey is in movement or stopped for only a very short period of time. Moreover, the various movements of the archer may be sensed by the prey and alert it.

SUMMARY OF THE INVENTION

It is an object of the present invention to provide a bow sight assembly on which a rangefinder is mounted and operated by a trigger mechanism which is also moving the bow sight proportionally, thereby reducing manipulation of devices to a minimum.

More particularly, the object of the present invention is to provide a bow sight assembly for use with a rangefinder mountable thereon, the assembly comprising:

a main frame;

connecting means for securing the main frame to a bow;

a sight positioning assembly comprising:

a substantially vertical member slidably connected to the main frame for operating the rangefinder, the member being movable between an upper position and a lower position;

a sight arm having a first end rotatably connected to the main frame about a first pivot axis, the sight arm being rotatable in a substantially vertical main plane around the first pivot axis between an upper position and a lower position, the sight arm comprising a curved slot longitudinally extending along it and having an end close to the first pivot axis;

an adjusting lever having a first end rotatably connected to the member about a second pivot axis, the lever being movable in the main plane about the second pivot axis and having a second end provided with a follower engaged in and movable along the curved slot;

the curved slot having a radius equal to the distance between the second pivot axis and the follower when the member and the sight arm are at their respective upper position, the curved slot having a center of curvature substantially coinciding with the second pivot axis when the member and the sight arm are at their respective upper position; and means for locking the lever in a given position relative to the member;

a sight pin secured to the sight arm and sidely projecting therefrom; and trigger means mounted on the main frame and mechanically connected to the sight positioning assembly for moving the member and the sight arm between their respective upper and lower positions.

A non restrictive description of a preferred embodiment will now be given with reference to the appended drawings.

DESCRIPTION OF A PREFERRED EMBODIMENT

Figure 1:
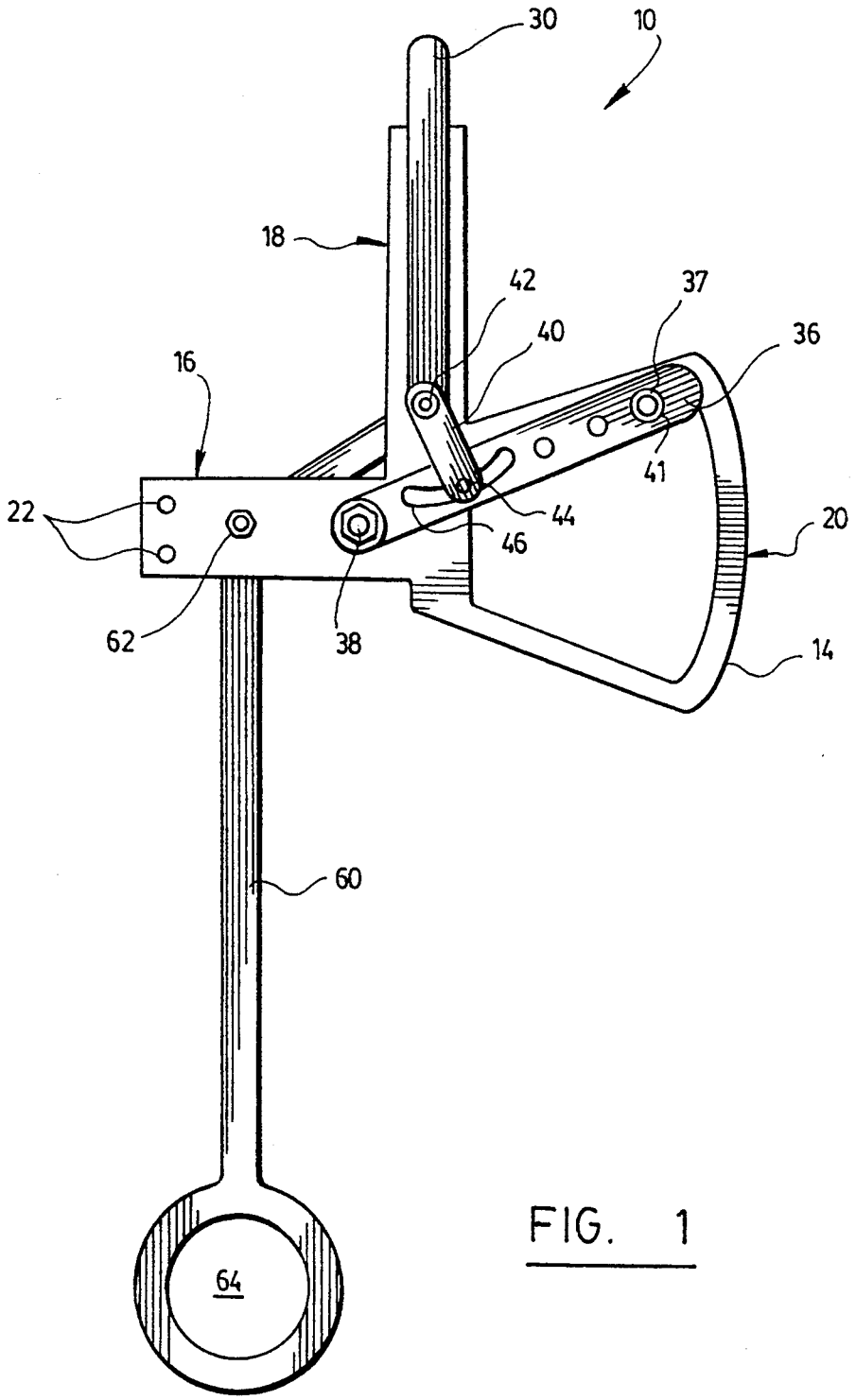
FIG. 1 is a right elevational view of the bow sight assembly according to the present invention.
Figure 2:
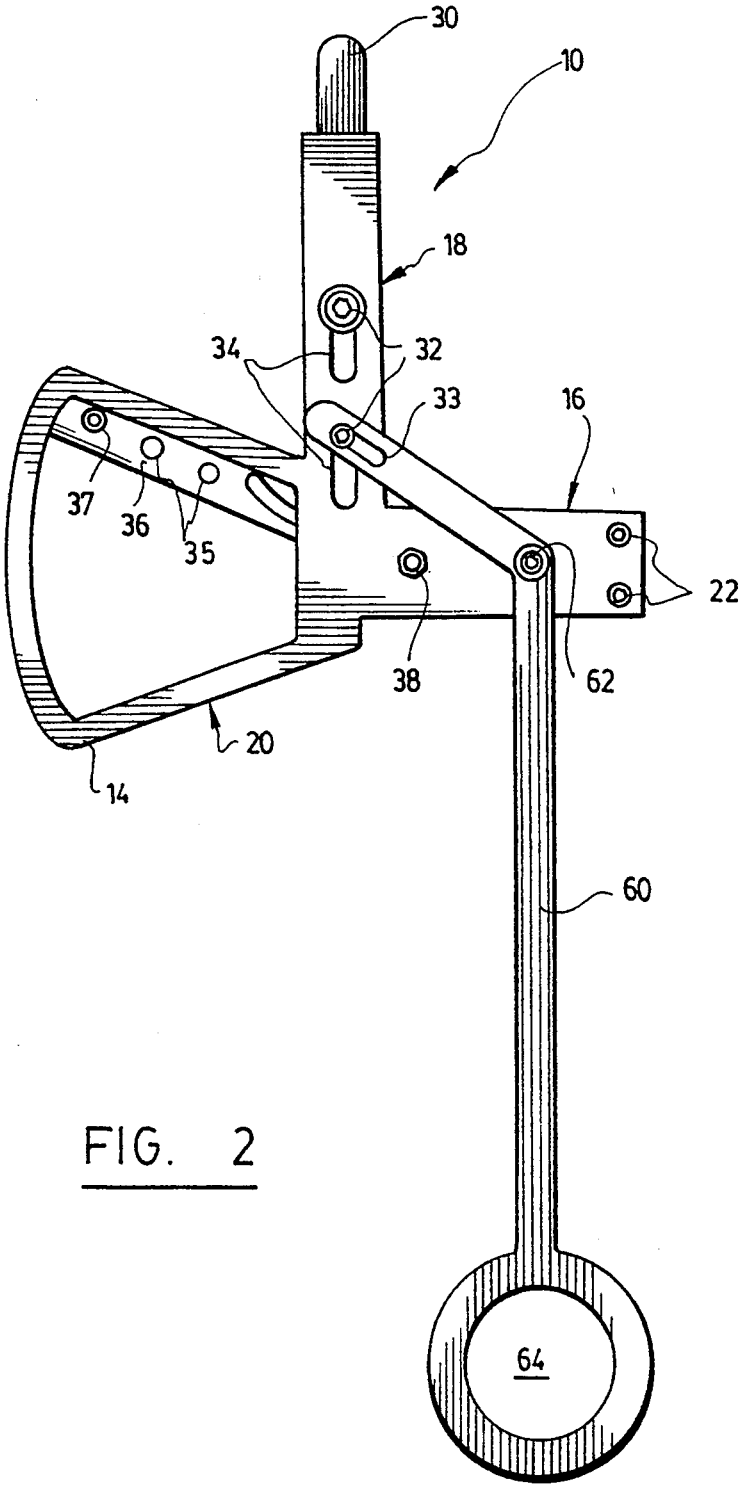
FIG. 2 is a left elevational view of the bow sight assembly of FIG. 1.
Figure 3:
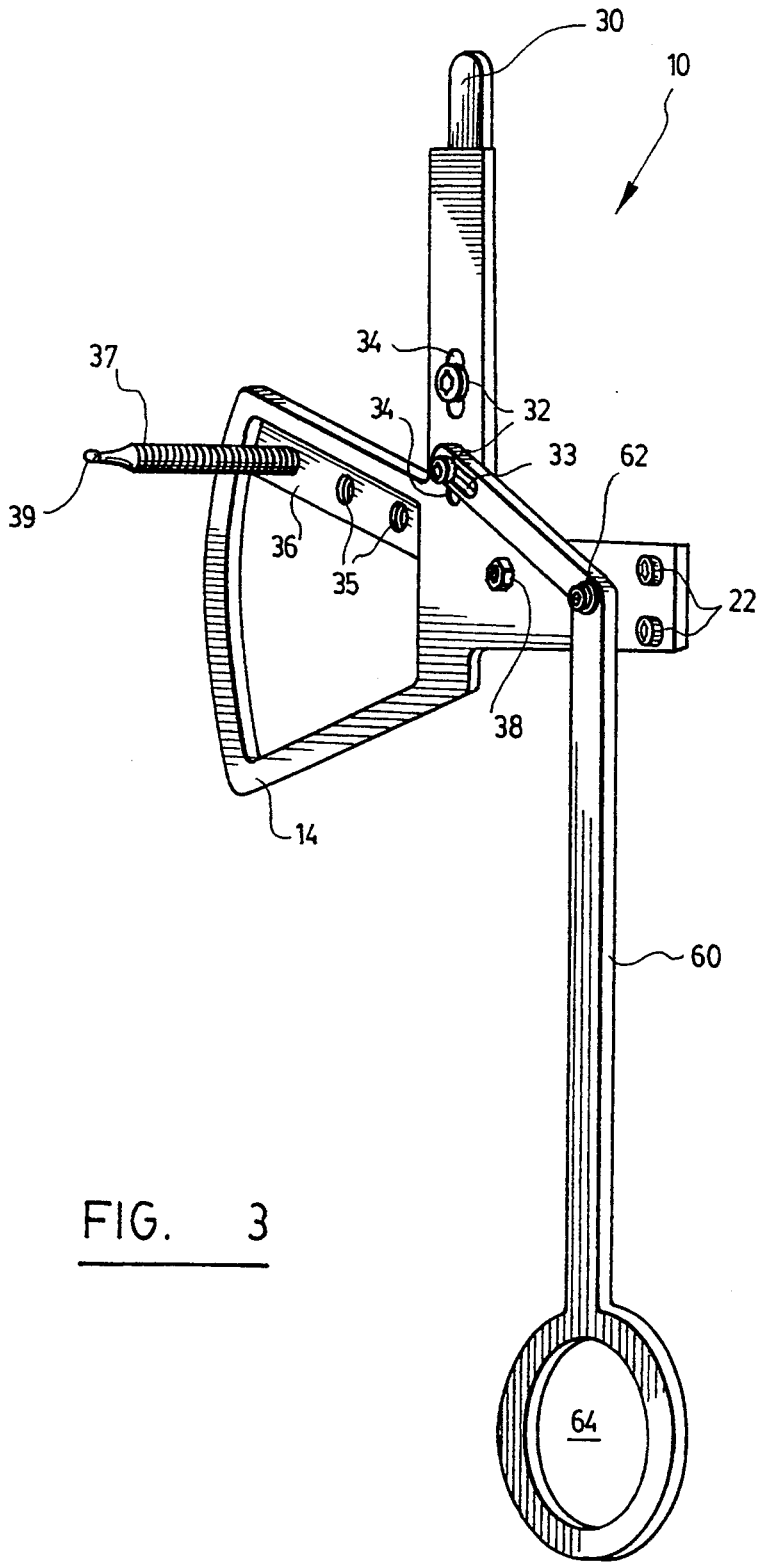
FIG. 3 is a side perspective view of the bow sight assembly of FIG. 1.
Figure 4:
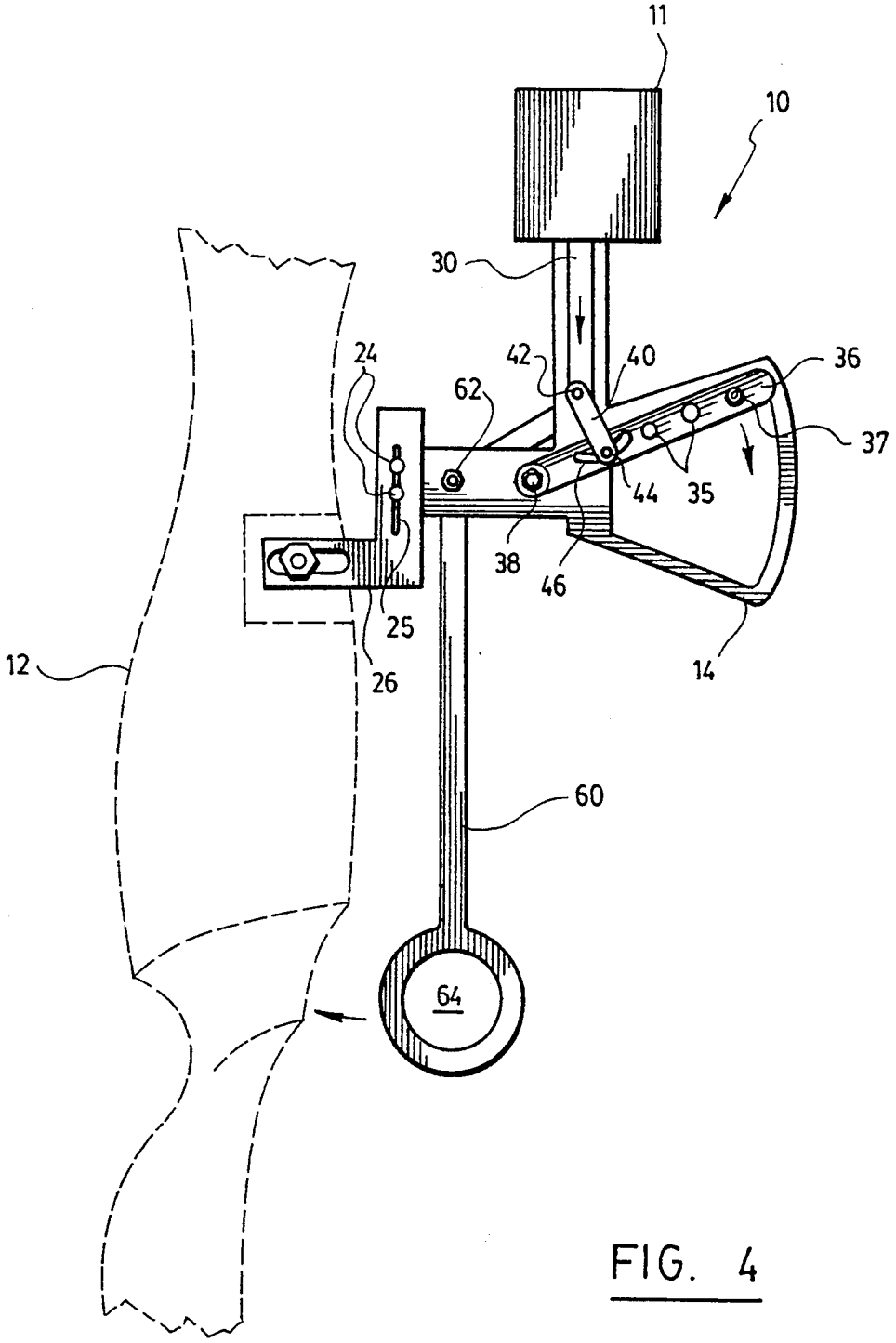
FIG. 4 is a right elevational view of the bow sight assembly of FIG. 1, provided with a rangefinder and mounted on a bow.

Referring to FIGS. 1 to 6, there is shown the bow sight assembly 10 adapted for installation on a bow 12 (FIG. 4). The assembly 10 comprises a main frame 14 which bears all the elements of the bow sight assembly 10. The main frame 14 is preferably made of a single flat piece having a horizontal portion 16, a vertical portion 18 and an opened portion 20.

The vertical portion 18 supports a split image rangefinder 11 mountable thereon (FIG. 4). As aforesaid, the split image rangefinder 11 functions with an optical mechanism generating an image having two halves, which are generally a right and a left half. The user then changes the setting of the rangefinder 11 until the two parts of the image appear to be aligned with each other. At that moment, the user can read the distance on the instrument scale and aim accordingly. In addition to split image rangefinders, other rangefinders involving various technologies, such as lasers for instance, may be suitably used.

Since the bow sight assembly 10 is connectable to the bow 12, connecting means are provided for securing the main frame 14 to the bow 12. The connecting means may be a set of holes 22 provided at the end of the horizontal portion 16 and in which bolts 24 are insertable in a slot 25 for securing the main frame 14 to a bracket 26 located on the bow 12 (FIG. 4). Of course, other types of devices may be used for connecting the main frame 14 to the bow 12.

The bow sight assembly 10 also comprises a sight positioning assembly having substantially three main movable parts. The first of those parts is a substantially vertical member 30 slidably connected to the main frame 14 and movable between an upper position and a lower position. The member 30 comprises two followers 32 respectively engaged in and movable along two vertical guiding slots 34 provided in the main frame 14.

The second part of the sight positioning assembly is a sight arm 36 having a first end rotatably connected to the main frame 14 about a pivot 38. The pivot 38 is preferably comprising a nut and a screw. The sight arm 36 is rotatable in a substantially vertical main plane around the pivot 38 between an upper position and a lower position. A sight pin 37 is secured to the sight arm 36 and sidely projecting therefrom. Preferably, the sight pin 37 is an elongated screw having a sharp free end provided with a rounded aiming tip 39 acting as an aiming point. The sight pin 37 is in mesh with one of a plurality of threaded holes 35 longitudinally provided along the sight arm 36.

The third part of the sight positioning assembly is an adjusting lever 40 movable in the main plane. The lever 40 has a first end rotatably connected to the member 30 about a pivot 42, and a second end provided with a follower 44 engaged in and movable along a curved slot 46. The curved slot 46 is longitudinally extending along the sight arm 36 and has an end close to the pivot 38. The curved slot 46 also has a radius equal to the distance between the pivot 42 and the follower 44 when the member 30 and the sight arm 36 are at their respective upper position. The curved slot 46 further has a center of curvature substantially coinciding with the pivot 42 when the member 30 and the sight arm 36 are at their respective upper position.

The sight positioning assembly has two simultaneous functions. The first function is to operate the rangefinder 11 by moving the member 30 until the instrument reads the range between the bow and the target. Simultaneously, the sight arm 36 rotates about the pivot 38 in direct proportion to the movement of the member 30. In use, the setting of the sight positioning assembly is that the sight arm 36 and its sight pin 37 are at the appropriate angle when the rangefinder is indicating the actual range between the bow and the target. As aforesaid, the appropriate angle of the sight pin 37 allows the archer to directly aim the target with the tip 39 and yet providing the right initial angle to the arrow. The farther the target, the lower the sight pin 37 will be.

Since all bows and archers are different, the sight positioning assembly has to be calibrated before its full use. In the preferred embodiment, the upper position and the lower position of the member 30 are always the same whatever bow is used since no substantial modifications are required on the rangefinder 11 when using different bows.

The common base point of the sight positioning assembly is the upper position of the sight arm 36, which corresponds to the shortest distance. Of course, the bow sight assembly 10 has to be at the proper position on the bow 12 before beginning the calibration. In the preferred embodiment, the whole bow sight assembly 10 may be moved by unscrewing the bolts 24 and moving them in the slot 25.

Figure 5:
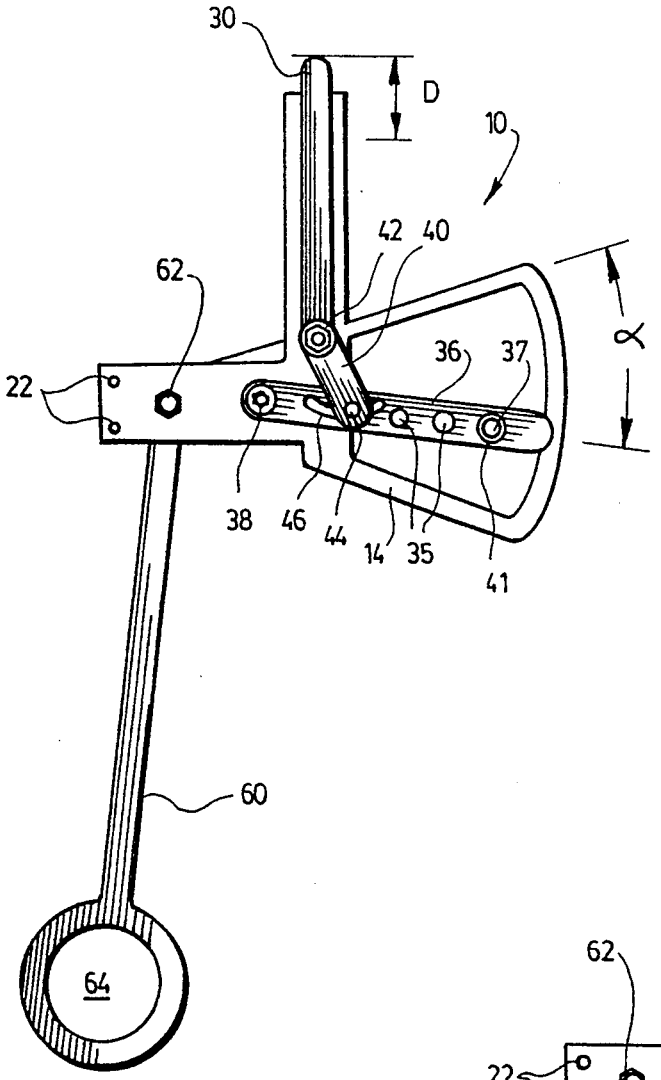
FIG. 5 is a right elevational view of the bow sight assembly of FIG. 1, showing a first example of the setting.
Figure 6:
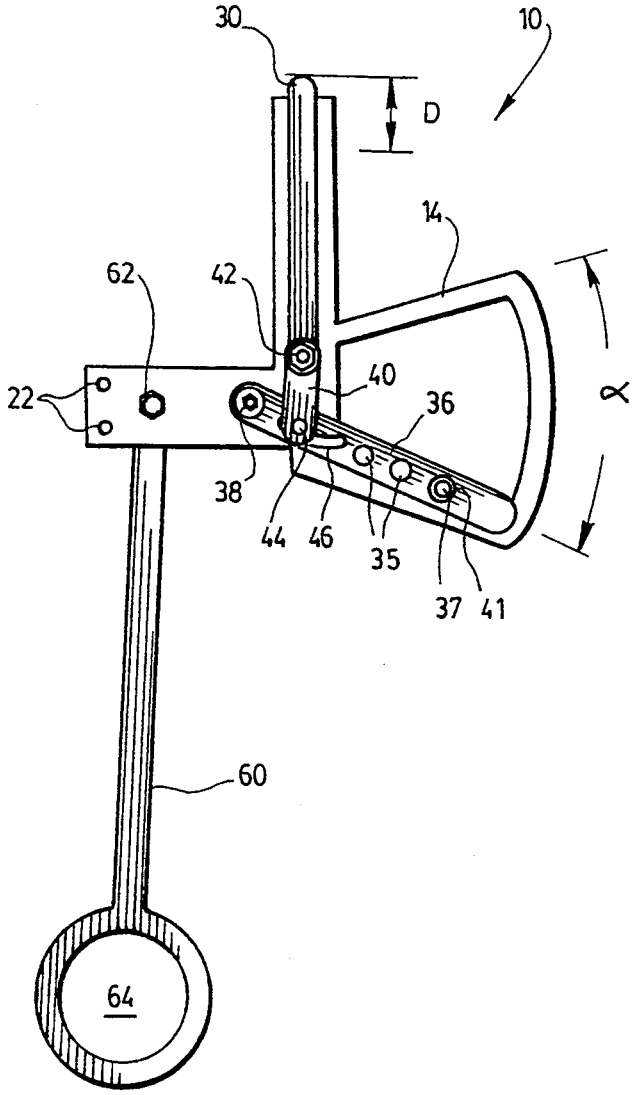
FIG. 6 is a right elevational view of the bow sight assembly of FIG. 1, showing a second example of the setting.

The main calibration step is the setting of the longest distance by changing the ratio between the vertical movement D of the member 30 and the angle $\alpha$ of the sight arm 36. The lever 40 is then used for setting the sight positioning assembly at the right ratio. As shown in FIGS. 5 and 6, the lower position of the sight pin 37 is dependant upon the position of the follower 44 in the slot 46. The calibration is done by practicing and rotating the lever 40 until the right position thereof is found. Means for locking the lever 40 in a given position relative to the member 30 are provided so that the lever 40 may move in unison with them, leaving the sight positioning assembly only one degree of freedom. Preferably, the means for preventing movement of the lever 40 comprise a finger operatable nut 50 in mesh with a threaded shaft coinciding with the pivot 42. Of course, another kind of locking means may be used.

Once the calibration of the long distance is done, the intermediary positions between the upper position and the lower position of the sight arm 36 will be set. If desired, the sight pin 37 may be moved to a different hole 35. The closer the sight pin 37 is from the pivot 38, the shorter the amplitude of the range, but the greater the precision within that range will be. For example, a typical range of the closer hole 35 is from 9 to 31 meters, while the opposite hole 35 is from 15 to 42 meters.

In addition to range calibration, it is possible to calibrate the sight pin 37, so that the arrow may travel straight forward towards the target. To compensate for lateral misalignments, the sight pin 37 may be screwed or unscrewed for moving the tip 39 left or right. Once the tip 39 is at the proper position, the sight pin 39 is locked by a nut 41 in mesh with the portion of the sight pin 37 projecting on the other side of the sight arm 36.

For operating the sight positioning assembly, and thus moving the member 30 and the sight arm 36 between their respective upper and lower positions, trigger means are mounted on the main frame 14 and are mechanically connected to the sight positioning assembly. In the preferred embodiment, the trigger means preferably comprise a substantially L-shaped finger operatable arm 60 having an upper end operatively connected to the member 30 and an intermediary point 62 rotatably connected to the main frame 14. The arm 60 is preferably connected to the member 30 to the lower follower 32 extending in a slot 33 provided in the arm 60. A round hole 64 allows a finger of the archer to operate the arm 60. Of course, the arm 60 may be connected to the sight arm 36 or even the lever 40 because the whole sight positioning assembly is moving in unison.

The bow sight assembly thus allows to spot the target, find the proper range, aim and shoot in a very short amount of time. It is thus particularly well adapted to bow hunting.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A bow sight assembly for use with a rangefinder mountable thereon, said assembly comprising:

a main frame;

connecting means for securing said main frame to a bow;

a sight positioning assembly comprising:

a substantially vertical member slidably connected to said main frame for operating said rangefinder, said member being movable between an upper position and a lower position;

a sight arm having a first end rotatably connected to said main frame about a first pivot axis, said sight arm being rotatable in a substantially vertical main plane around said first pivot axis between an upper position and a lower position, said sight arm comprising a curved slot longitudinally extending along it and having an end close to said first pivot axis;

an adjusting lever having a first end rotatably connected to said member about a second pivot axis, said lever being movable in said main plane about said second pivot axis and having a second end provided with a follower engaged in and movable along said curved slot;

said curved slot having a radius equal to the distance between said second pivot axis and said follower when said member and said sight arm are at their respective upper position, said curved slot having a center of curvature substantially coinciding with said second pivot axis when said member and said sight arm are at their respective upper position; and means for locking said lever in a given position relative to said member;

a sight pin secured to said sight arm and sidely projecting therefrom; and trigger means mounted on said main frame and mechanically connected to said sight positioning assembly for moving said member and said sight arm between their respective upper and lower positions.

2. A bow sight assembly according to claim 1, wherein said trigger means comprise a substantially L-shaped finger operatable arm having an upper end operatively connected to said member and an intermediary point rotatably connected to said main frame.

3. A bow sight assembly according to claim 1, wherein said sight pin comprises an elongated screw having a sharp free end provided with a rounded aiming tip, said screw being in mesh with one of a plurality of threaded holes longitudinally provided along said sight arm.

4. A bow sight assembly according to claim 1, wherein said means for preventing movement of said lever comprise a finger operatable nut in mesh with a threaded shaft coinciding with said second pivot axis.

5. A bow sight assembly comprising:

a main frame;

a split image rangefinder mountable on said main frame;

connecting means for securing said main frame to a bow;

a sight positioning assembly comprising:

a substantially vertical member slidably connected to said main frame for operating said rangefinder, said member being movable between an upper position and a lower position;

a sight arm having a first end rotatably connected to said main frame about a first pivot axis, said sight arm being rotatable in a substantially vertical main plane around said first pivot axis between an upper position and a lower position, said sight arm comprising a curved slot longitudinally extending along it and having an end close to said first pivot axis;

an adjusting lever having a first end rotatably connected to said member about a second pivot axis, said lever being movable in said main plane about said second pivot axis, said lever having a second end provided with a follower engaged in and movable along said curved slot;

said curved slot having a radius equal to the distance between said second pivot axis and said follower when said member and said sight arm are at their respective upper position, said curved slot having a center of curvature substantially coinciding with said second pivot axis when said member and said sight arm are at their respective upper position; and means for locking said lever in a given position relative to said member;

a sight pin secured to said sight arm and sidely projecting therefrom; and trigger means mounted on said main frame and mechanically connected to said sight positioning assembly for moving said member and said sight arm between their respective upper and lower positions.

6. A bow sight assembly according to claim 5, wherein said trigger means comprise a substantially L-shaped finger operatable arm having an upper end operatively connected to said member and an intermediary point rotatably connected to said main frame.

7. A bow sight assembly according to claim 5, wherein said sight pin comprises an elongated screw having a sharp free end provided with a rounded aiming tip, said screw being in mesh with one of a plurality of threaded holes longitudinally provided along said sight arm.

8. A bow sight assembly according to claim 5, wherein said means for preventing movement of said lever comprise a finger operatable nut in mesh with a threaded shaft coinciding with said second pivot axis.

* * * * *